US007390352B2

(12) United States Patent
Leng et al.

(10) Patent No.: US 7,390,352 B2
(45) Date of Patent: Jun. 24, 2008

(54) AIR PURIFIER WITH FRONT-LOAD ELECTRODES

(75) Inventors: Shengwen Leng, Shenzen (CN); Guangsheng Liu, Shenzen (CN)

(73) Assignee: Sylmark Holdings Limited (IE)

( * ) Notice: Subject to any disclaimer, the term of this patent is extended or adjusted under 35 U.S.C. 154(b) by 228 days.

(21) Appl. No.: 11/378,952

(22) Filed: Mar. 17, 2006

(65) Prior Publication Data

US 2007/0214958 A1 Sep. 20, 2007

(51) Int. Cl.
*B03C 3/74* (2006.01)

(52) U.S. Cl. ..... 96/39; 95/74; 96/86; 96/94

(58) Field of Classification Search ..... 96/15, 96/39–41, 51, 78, 79, 84, 86, 87, 94; 95/57, 95/74; 422/186.04
See application file for complete search history.

(56) References Cited

U.S. PATENT DOCUMENTS

| | | | | |
|---|---|---|---|---|
| 6,713,026 | B2 * | 3/2004 | Taylor et al. | 422/186.04 |
| 7,077,890 | B2 * | 7/2006 | Botvinnik | 96/69 |
| 7,291,207 | B2 * | 11/2007 | Taylor et al. | 96/83 |
| 7,309,386 | B2 * | 12/2007 | Wu et al. | 96/70 |
| 7,311,762 | B2 * | 12/2007 | Taylor et al. | 96/39 |
| 2005/0051028 | A1 * | 3/2005 | Botvinnik | 96/88 |
| 2006/0018811 | A1 * | 1/2006 | Taylor et al. | 422/186.04 |
| 2006/0021509 | A1 * | 2/2006 | Taylor et al. | 96/83 |
| 2006/0053758 | A1 * | 3/2006 | Wu et al. | 55/471 |
| 2006/0278074 | A1 * | 12/2006 | Tseng et al. | 95/57 |

* cited by examiner

*Primary Examiner*—Richard L Chiesa
(74) *Attorney, Agent, or Firm*—Kathy Mojibi Kavcloglu

(57) ABSTRACT

An air purifier with front-loading electrodes includes an electrode loading compartment for storing the plate electrodes. When the air purifier is in a closed configuration, the electrode loading compartment cooperates with the housing to fully enclose the plate electrodes. When the plate electrodes need to be removed, the electrode loading compartment can be moved translationally with respect to the housing to define a gap therebetween. The electrode loading compartment can then be rotated to access and remove the plate electrodes.

7 Claims, 3 Drawing Sheets

AIR PURIFIER WITH FRONT-LOAD ELECTRODES

FIELD OF INVENTION

The present invention relates generally to electrokinetic air purifiers, and more particularly, to an electrokinetic air purifier wherein the electrode blades are loaded from the front of the unit.

BACKGROUND OF THE INVENTION

Electrostatic or electrokinetic air cleaners use electric energy to generate electrostatic forces which create air flow without the use of a fan or other moving parts. Electrostatic forces also enable the air cleaner to collect airborne contaminants such as dust, smoke, oil mist, pollen, pet dander and other small debris particles from the air circulated in dwellings, workplaces, and other structures. Generally, known electrokinetic air cleaners utilize two arrays of electrodes excited by high-voltage. In a known design, the first electrode array comprises wire or rod-shaped electrodes (hereinafter "wire electrodes"), while the second electrode array comprises plate electrodes. A high-voltage generator creates an electrical charge between the first and second electrode arrays.

The particulate matter enters the region of the first electrode array and is charged before entering the region of the second electrode array, where it is removed from the air stream. Specifically, due to the high-voltage charge at the wire electrodes, free electrons are stripped off of atoms and molecules in the surrounding air. These electrons migrate to the positively charged wire electrodes, where they are collected. The removal of free electrons leaves the stripped atoms and molecules positively charged, which are repelled from the positively charged wire electrodes and attracted to the negatively charged plate electrodes. The addition of the electrons from the negatively charged plate electrodes also produces negative air ions that are propelled from the trailing edge of the plate electrodes. Thus, the ionic forces exerted on atoms and molecules create a silent movement of air through the air cleaner.

Because collected and adhered debris greatly reduces an electrode's efficiency and effectiveness, the debris must be periodically removed. Commonly, the electrode assembly is removed and wiped clean. U.S. Pat. No. 6,713,026 describes (at least in the claims thereof) cleaning the electrode plates by lifting the electrode plates vertically out through an opening in the top of the housing, cleaning the removed electrode plates, and then inserting the cleaned plates through the opening in the top of the housing. This is accomplished with the housing held in a vertical orientation, with the result being that as the electrode plate assembly is inserted, gravity assists in pulling the electrode plate assembly down into the housing. The feature wherein the electrode assembly is inserted and removed from an opening in the top of the housing is hereinafter referred to as "top-loaded."

The top-loaded air purifier inconveniences the user by requiring the user to vertically lift the electrode assembly for a distance equal to the length of the electrode blades. The electrode blades are heavy, typically made of steel or other metal. Furthermore, the blades are long, typically spanning 12-20 inches. To lift the heavy electrode assembly and remove it from the air purifier can be difficult, particularly for an elderly or weaker user. Moreover, because the electrode assembly is heavy, the user can drop the electrode assembly, causing damage to the electrodes or to the internal electrical components of the air purifier. To avoid this inconvenience, a user may choose to forego the necessary periodic cleaning of the electrode assembly, causing the air purifier unit to operate inefficiently.

To maximize the efficiency of the air purifier unit, it is desirous to have a unit that facilitates the removal and insertion of the electrode assembly.

DETAILED DESCRIPTION OF PREFERRED EMBODIMENTS

Figure 1:
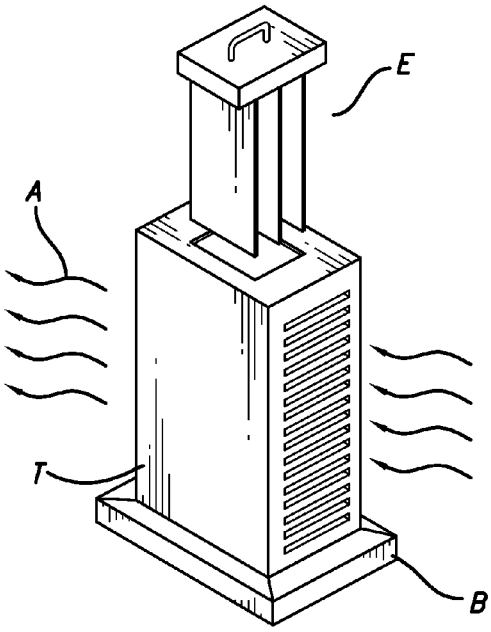
FIG. 1 PRIOR ART
FIG. 1 is a perspective view of a prior art ionic air purification device comprising a housing and a top-loaded electrode assembly.

Referring now to the drawing figures, wherein like reference numerals represent like parts throughout the several views, FIG. 1 shows a prior art ionic air purifier device. The prior art ionic air purifier device shown in FIG. 1 is intended to be schematic in form in that it does not represent the particular look of any particular prior art device. However, it shares common features with many prior art devices of this type. First, it has a base B, an upright tower T, the tower is louvered or slatted, and it has a removable electrode plate assembly E. The air purifier device, as shown, is a tower-style ionic air purifier device that uses ionic forces to move and clean air. Such a device uses electrical energy to generate electrostatic forces, which create air flow without the use of moving parts. Electrostatic forces also enable the purifier to collect airborne contaminants, such as dust, pet dander and other small particles, on three collector plate electrodes. The electrostatic forces are generated by two arrays of electrodes excited by high-voltage. A simple electronic circuit for operating the device is employed (typically).

As is common in such devices, a first electrode array comprises a plurality of wire or rod-shaped electrodes, which are coupled using a common bus to a positive terminal of a high-voltage generator. The second electrode array comprises a corresponding number of solid collector plate electrodes. The high-voltage generator creates an electrical charge between the electrode arrays. The resulting ionic forces create a silent movement of air in the direction of direction arrows A.

As shown in FIG. 1, the plate electrodes of the second electrode array can be removed for cleaning, and then the cleaned plate electrodes can be reinserted into the housing for use. In the known air purifier device, the plate electrodes are removed from the housing vertically through an opening in its top. After cleaning, the plate electrodes are returned to the housing vertically, again through the opening in its top.

Figure 2:
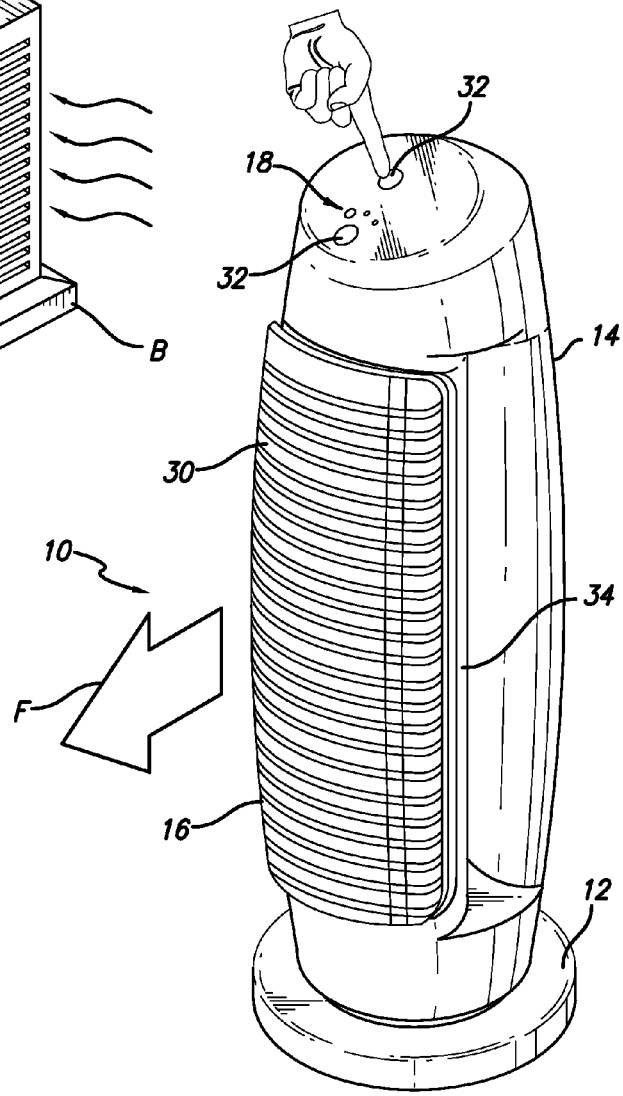
FIG. 2 is a perspective view of a preferred embodiment of the front-loaded air purifier of the present invention.
Figure 3:
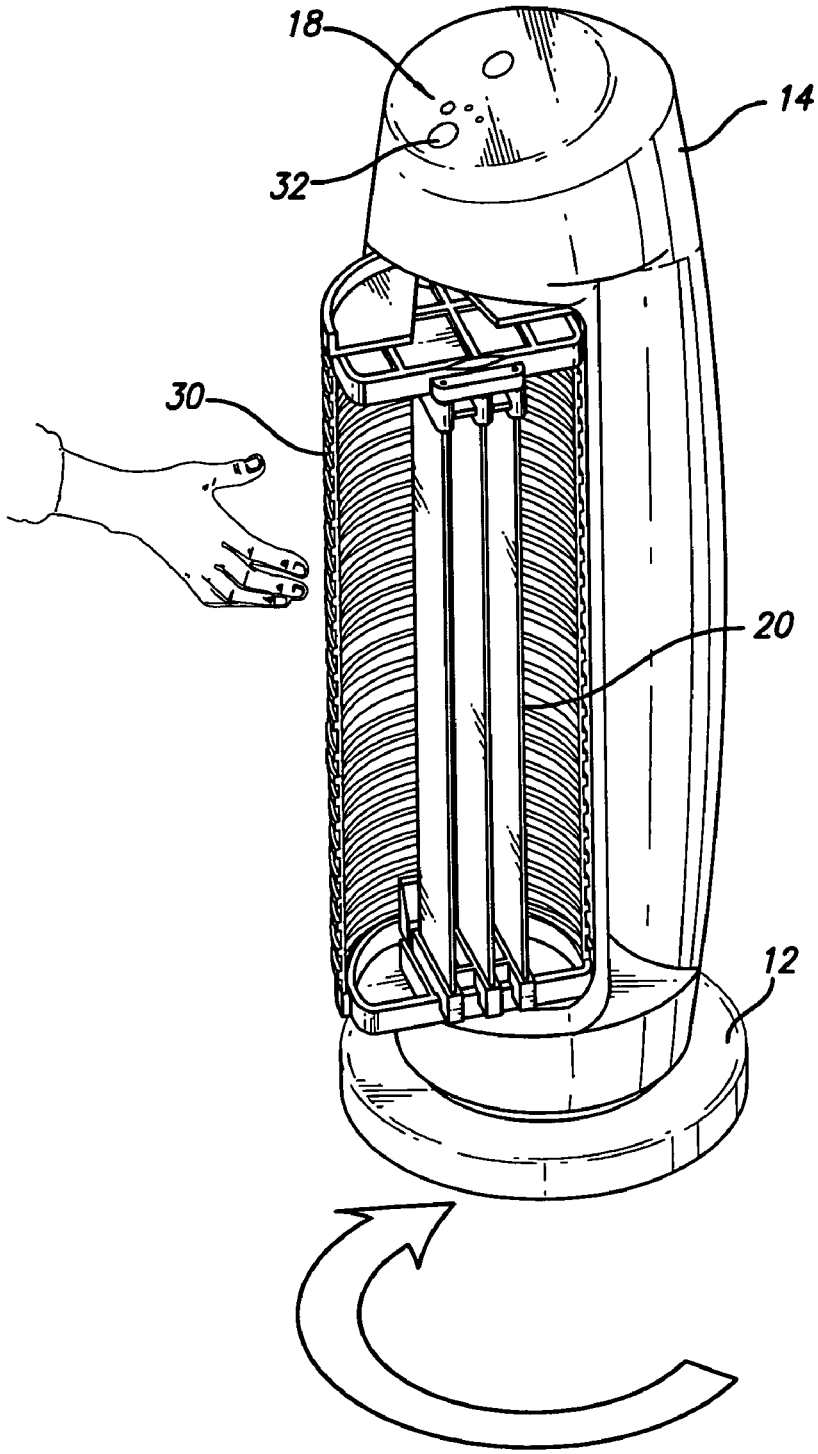
FIG. 3 is another perspective view of a preferred embodiment of the front-loaded air purifier of the present invention showing the collector electrodes installed therein.

FIGS. 2 and 3 depict a preferred embodiment of the air purifier 10 of the present invention, wherein the plate electrodes 20 are front-loaded. It will be appreciated that terms such as "front," "forward," "down," "downward," and other positionally descriptive terms used herein are used merely for ease of description and refer to the orientation of the components when the air purifier 10 is in the vertically upright position shown for example in FIGS. 2 and 3. It should be understood that any orientation of the elements described herein is within the scope of the present invention. These positionally descriptive terms are not intended to limit the scope of the claims.

Air purifier 10 includes a base 12, housing 14, vents 16 and control panel 18. In a preferred embodiment of the invention, an electrode loading compartment 30 carries the plate electrodes 20. In a closed configuration, the electrode loading compartment 30 cooperates with the housing 14 to enclose the electrokinetic components therein. In its open configuration, shown in FIG. 3, the electrode loading compartment moves relative to the housing 14, to allow the user to easily access and remove the plate electrodes 20.

In a preferred embodiment of the invention, the electrode loading compartment 30 moves translationally and pivotally in relation to the housing 14. As shown in FIG. 2, upon activation of a release button 32, the electrode loading compartment 30 moves translationally in a direction F away from the housing, creating a clearance gap 34 between the housing 14 and the electrode loading compartment 30. The electrode loading compartment 30 then rotates to allow the user access to the plate electrodes 20 installed in the electrode loading compartment 30.

Those skilled in the art will understand that there are many known mechanical configurations that would cause the electrode loading compartment 30 to move in relation to the housing 14. A preferred embodiment of the mechanical configuration is described below. However, the invention is not limited to the described embodiment. Any known mechanical structure that causes the electrode loading compartment 30 to move relative to the housing 14 can be used.

Figure 4:
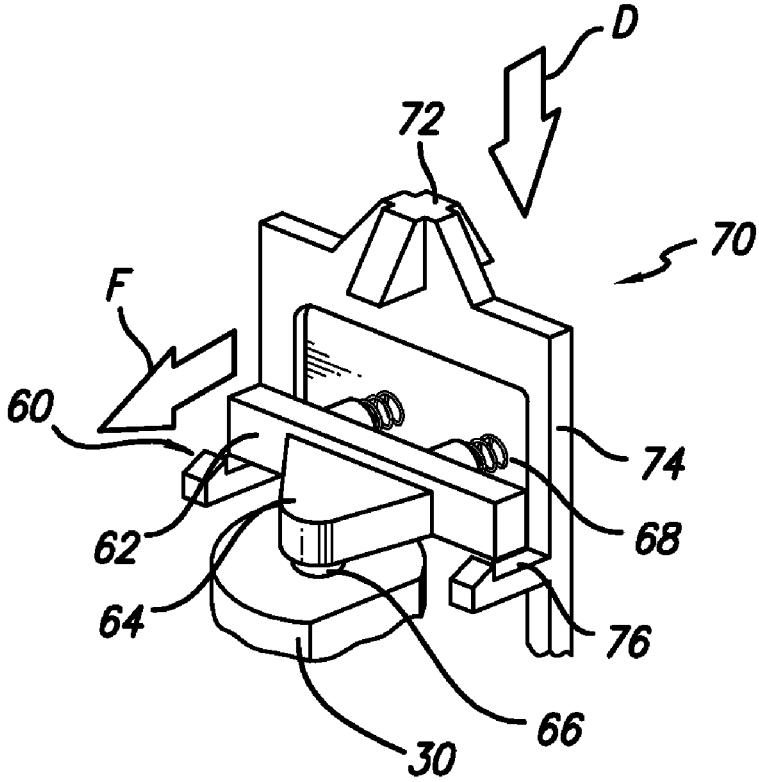
FIG. 4 is a perspective view of a preferred embodiment of the release mechanism of the present invention.

FIG. 4 depicts a preferred embodiment of the release mechanism 60 of the air purifier 10 of the present invention. The release mechanism, when activated, causes the electrode loading compartment 30 to move in relation to the housing. In a preferred embodiment, the release mechanism includes a drive platform 62 and a protrusion 64 extending from the drive platform 62. The electrode loading compartment 30 is preferably mounted on and rotatable about a shaft 66 extending from the protrusion 64 of the drive platform 62. The drive platform 62 is biased in the direction F by springs 68. During operation of the air purifier 10, the drive platform 62 is restrained by a latch mechanism 70. The latch mechanism 70 includes an activation portion 72, a pair of support extensions 74 and a pair of latches 76. Each latch 76 preferably extends traversely from a support extension and is positioned to engage and restrain the drive platform 62.

To activate the release mechanism 60, the user can press release button 32 (shown in FIG. 2). The release button 32 applies force D to the activation portion 72 of the latch mechanism 70. Force D causes the latch mechanism 70 to move downward. As the support extensions 74 move downward, latches 76 disengage the drive platform 62. When the drive platform 62 disengages from the latches 76, springs 68 push the drive platform 62 in the direction F causing the electrode loading compartment 30 to move translationally with respect to housing 14, as shown in FIG. 2. The electrode loading compartment 30 can then be rotated, as shown in FIG. 3, to provide convenient access to the plate electrodes 20. In the embodiment shown in FIG. 3, the electrode loading compartment 30 is rotated manually. However, it is within the scope of the invention to automate the rotation of the electrode loading compartment 30 by using a torsion spring or other known mechanical device.

Many modifications and other embodiments of the invention set forth herein will come to mind to one skilled in the art to which the invention pertains having the benefit of the teachings presented in the foregoing descriptions and the associated drawings. For example, the shape of the electrodes is not limited to a plate-shape but can vary. Furthermore, wherein the front-loading feature is described herein, the invention encompasses loading from the side or from the rear of the housing. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An air purifier comprising:

a housing;

an electrode loading compartment connected to the housing;

a plate electrode removably positioned in the electrode loading compartment;

a first configuration wherein the housing and electrode loading compartment enclose the plate electrodes;

a second configuration wherein the electrode loading compartment moves translationally away from the housing to define a gap therebetween; and a drive platform, the electrode loading compartment rotatably mounted on the drive platform, wherein in the second configuration, the electrode loading compartment rotates with respect to the drive platform.

2. The air purifier of claim 1 wherein the electrode loading compartment is biased in a direction away from the housing.

3. The air purifier of claim 2 further comprising a latch mechanism, the latch mechanism engaging the electrode loading compartment in the first configuration and disengaging the electrode loading compartment in the second configuration.

4. The air purifier of claim 1, further comprising a control button, the control button operatively connected to the electrode loading compartment, wherein when the control button is activated, the air purifier transitions for the first configuration to the second configuration.

5. An air purifier comprising:

a housing;

an electrode loading compartment connected to the housing, the electrode loading compartment defining a plurality of vents thereon;

a plate electrode removably positioned in the electrode loading compartment;

a drive platform biased in a direction away from the housing and configured to move translationally with respect to the housing, wherein the electrode loading compartment is mounted on the drive platform; and a latch mechanism, comprising an activation portion, a support extension and a latch extending from the support extension, wherein in a release configuration, a force applied to the activation portion causes the latch to release the drive platform and wheretin in a closed configuration, the latch mechanism is configured to engage the drive platform to prevent the drive platform from movin translationally.

6. An air purifier comprising:

a housing;

an electrode loading compartment connected to the housing, the electrode loading compartment defining a plurality of vents thereon;

a plate electrode removably positioned in the electrode loading compartment;

a drive platform biased in a direction away from the housing and configured to move translationally with respect to the housing, wherein the electrode loading compartment is mounted on the drive platform;

wherein the electrode loading compartment is rotatably attached to the drive platform and wherein in a release configuration, after the drive platform has moved translationally with respect to the housing, the electrode loading compartment is configured to rotate.

7. The air purifier of claim 5, further comprising a control button, the control button operatively connected to the activation portion of the latch mechanism, wherein when the control button is activated, the air purifier transitions for the closed configuration to the release configuration.

* * * * *